US006997450B2

(12) United States Patent
Trovinger

(10) Patent No.: US 6,997,450 B2
(45) Date of Patent: Feb. 14, 2006

(54) SHEET FOLDING AND ACCUMULATION SYSTEM FOR A BOOKLET MAKER

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 100 days.

(21) Appl. No.: 10/681,151

(22) Filed: Oct. 9, 2003

(65) Prior Publication Data

US 2005/0077671 A1 Apr. 14, 2005

(51) Int. Cl.
*B41L 43/00* (2006.01)

(52) U.S. Cl. ..... 270/52.26; 270/52.3; 270/32

(58) Field of Classification Search ..... 270/52.26, 270/52.27, 52.28, 52.29, 52.3, 32
See application file for complete search history.

(56) References Cited

U.S. PATENT DOCUMENTS

| | | | | |
|---|---|---|---|---|
| 3,692,300 A | * | 9/1972 | Mebus | 270/52.26 |
| 3,897,051 A | * | 7/1975 | Muller | 270/43 |
| 4,053,150 A | | 10/1977 | Lane | |
| 4,221,373 A | | 9/1980 | Muller Hans | |
| 4,484,501 A | | 11/1984 | Ramcke | |
| 4,571,237 A | | 2/1986 | Vogtlander | |
| 4,575,296 A | | 3/1986 | Kockler et al. | |
| 4,595,187 A | | 6/1986 | Bober | |
| 4,643,705 A | | 2/1987 | Bober | |
| 4,795,071 A | | 1/1989 | Jacobs et al. | |
| 4,891,681 A | | 1/1990 | Fiske et al. | |
| 4,989,850 A | * | 2/1991 | Weller | 270/1.02 |
| 5,028,193 A | | 7/1991 | Misicka | |
| 5,087,163 A | | 2/1992 | Erdbories et al. | |
| 5,100,118 A | * | 3/1992 | Hobbs et al. | 270/52.17 |
| 5,169,376 A | | 12/1992 | Ries et al. | |
| 5,377,965 A | | 1/1995 | Mandel et al. | |
| 5,465,213 A | | 11/1995 | Ross | |
| 5,632,587 A | | 5/1997 | Coyette | |
| 5,662,318 A | | 9/1997 | Harada et al. | |
| 5,779,232 A | | 7/1998 | Ochsner | |
| 5,803,891 A | | 9/1998 | Haan et al. | |
| 5,913,625 A | | 6/1999 | Trovinger et al. | |
| 5,997,197 A | | 12/1999 | Trovinger et al. | |
| 6,099,225 A | | 8/2000 | Allen et al. | |
| 6,120,427 A | | 9/2000 | Haan et al. | |
| 6,193,458 B1 | | 2/2001 | Marsh | |
| 6,334,723 B1 | | 1/2002 | Trovinger et al. | |

(Continued)

FOREIGN PATENT DOCUMENTS

WO WO 0018583 4/2000

OTHER PUBLICATIONS

Trovinger, U.S. Appl. No. 10/621,438 filed Jul. 18, 2003, entitled "Method and Device for Trimming Sheet Material".

(Continued)

*Primary Examiner*—Patrick Mackey

(57) ABSTRACT

A sheet folding and accumulation system and method inverts folded sheets onto a saddle where the sheets are accumulated and bound into a booklet. The inverting of the sheets onto the saddle for accumulation and binding eliminates the need for the saddle or other sheet collection member to translate or pivot for location of the sheets onto the saddle. A sheet folding and accumulation system includes a folding mechanism configured to form a fold in a sheet, a saddle for collecting folded sheets into a booklet for binding, and an inverting mechanism for inverting the folded sheet and placing the folded sheet onto the saddle with the peak of the fold in the sheet pointing upward.

37 Claims, 6 Drawing Sheets

U.S. PATENT DOCUMENTS

| | | | |
|---|---|---|---|
| 6,363,851 | B1 | 4/2002 | Gerhard et al. |
| 6,550,756 | B1 | 4/2003 | Trovinger |
| 6,554,267 | B1 | 4/2003 | Trovinger |
| 6,578,838 | B1 | 6/2003 | Trovinger et al. |
| 6,619,900 | B1 | 9/2003 | Cobene, II et al. |
| 6,632,061 | B1 | 10/2003 | Trovinger |
| 6,673,002 | B1 | 1/2004 | Trovinger et al. |
| 6,682,285 | B1 | 1/2004 | Trovinger et al. |
| 6,705,786 | B1 | 3/2004 | Trovinger |
| 6,708,967 | B1 | 3/2004 | Trovinger et al. |
| 6,715,749 | B1 | 4/2004 | Trovinger |
| 6,796,554 | B1 | 9/2004 | Trovinger |
| 6,808,479 | B1 | 10/2004 | Trovinger et al. |
| 2002/0168247 | A1 | 11/2002 | Trovinger et al. |
| 2003/0069118 | A1 | 4/2003 | Trovinger et al. |
| 2003/0069119 | A1 | 4/2003 | Trovinger et al. |
| 2003/0161704 | A1 | 8/2003 | Trovinger |
| 2003/0161705 | A1 | 8/2003 | Trovinger |
| 2003/0162644 | A1 | 8/2003 | Trovinger |
| 2004/0048728 | A1 | 3/2004 | Trovinger et al. |
| 2004/0063560 | A1 | 4/2004 | Trovinger |
| 2004/0089999 | A1 | 5/2004 | Trovinger et al. |
| 2004/0091336 | A1 | 5/2004 | Trovinger |
| 2004/0092377 | A1 | 5/2004 | Trovinger |
| 2004/0094884 | A1 | 5/2004 | Trovinger et al. |
| 2004/0094891 | A1 | 5/2004 | Trovinger et al. |
| 2004/0188910 | A1 | 9/2004 | Trovinger et al. |
| 2004/0239027 | A1 | 12/2004 | Trovinger et al. |

OTHER PUBLICATIONS

Trovinger, U.S. Appl. No. 10/681,315 filed Oct. 9, 2003, entitled "Sheet Folding and Trimming Apparatus".

Trovinger et al., U.S. Appl. No. 10/698,499 filed Oct. 30, 2003, entitled "Method and Apparatus for Making Booklets".

* cited by examiner

SHEET FOLDING AND ACCUMULATION SYSTEM FOR A BOOKLET MAKER

FIELD OF THE INVENTION

The invention relates to a booklet maker which folds and assembles sheets into booklets, and more particularly, the invention relates to a sheet folding and accumulation system which inverts and stacks folded sheets during assembly of the booklet.

DESCRIPTION OF THE RELATED ART

Duplex printed sheets are often bound into finished documents, such as booklets, by a paper-handling accessory. Machines which perform finishing operations, such as binding, folding, trimming, saddle stapling, and hole drilling can be combined to form a booklet maker. Booklet making systems can operate to collect folded sheets on a workpiece by rotating the workpiece to place the two portions of the folded sheet on opposite sides of the workpiece. Collected sheets can then be bound into a booklet.

For example, a system for finishing printed sheets into booklets is described in U.S. Pat. No. 6,099,225 (Allen et al.), hereby incorporated by reference in its entirety. The '225 patent discloses an inverted V-shaped workpiece for collecting folded booklet sheets.

A system for making saddle-stitched booklets on a sheet-wise basis is disclosed in PCT No. WO 00/18583 (Trovinger et al.), herein incorporated by reference in its entirety. In this system, folded booklet sheets are forwarded from a folding device to a reciprocating saddle with the use of a secondary drive system. The reciprocating saddle is described as permitting a trailing side of a folded sheet to be transported onto the backside of the saddle.

U.S. patent application Ser. No. 10/084,459, filed Feb. 28, 2003, entitled "SYSTEM FOR HANDLING FOLDED SHEET MATERIAL" (Trovinger), hereby incorporated by reference in its entirety, discloses a system for moving folded sheets to a collecting device and clamping the folded sheets against the collecting device. The folded sheets are moved to the collecting device in a non-linear path, where each sheet is delivered to the collecting device such that a leading side and a trailing side of the sheet are respectively delivered to different sides of the collecting device.

U.S. patent application Ser. No. 10/084,460, filed Feb. 28, 2003, entitled "BOOKLET MAKER" (Trovinger), hereby incorporated by referenced in its entirety, discloses a booklet maker including a pivotable collecting device. The pivotable collecting device has two supporting sides formed with a saddle shape, and a rotatable transferring device including a displaceable clamping component. The transferring device delivers a folded sheet material to the collecting device along a non-linear path, and the collecting device pivots to receive the folded sheet material from the transferring device such that different portions of the folded sheet material are supported by different sides of the two supporting sides of the collecting device.

U.S. patent application Ser. No. 10/084,462, filed Feb. 28, 2003, entitled "PIVOTABLE COLLECTING DEVICE" (Trovinger), hereby incorporated by reference in its entirety, also discloses a pivotable collecting device for handling a folded sheet material.

SUMMARY OF THE INVENTION

The present invention relates to a sheet folding and accumulation system and method which inverts folded sheets onto a saddle for binding into a booklet.

In accordance with one aspect of the invention, a sheet folding and accumulation system which inverts folded sheets to assemble a booklet, includes a folding mechanism configured to form a fold in a sheet, a saddle for collecting folded sheets into a booklet for binding and an inverting mechanism for inverting the folded sheet and placing the folded sheet onto the saddle with the peak of the fold in the sheet pointing upward.

In accordance with another aspect of the invention, a method of folding and accumulating sheets into a booklet, comprises (a) folding a sheet in preparation for assembling the sheet into a booklet, (b) inverting the sheet and placing the inverted sheet onto a saddle with a peak of a fold in the sheet pointing upward, (c) repeating steps (a) and (b) with a plurality of sheets to form a stack of folded sheets on the saddle, and (d) binding the stack of sheets on the saddle to form a booklet.

BRIEF DESCRIPTION OF THE DRAWING FIGURES

The invention will now be described in greater detail with reference to the preferred embodiments illustrated in the accompanying drawings, in which like elements bear like reference numerals, and wherein.

DETAILED DESCRIPTION OF THE INVENTION

Figure 1A:
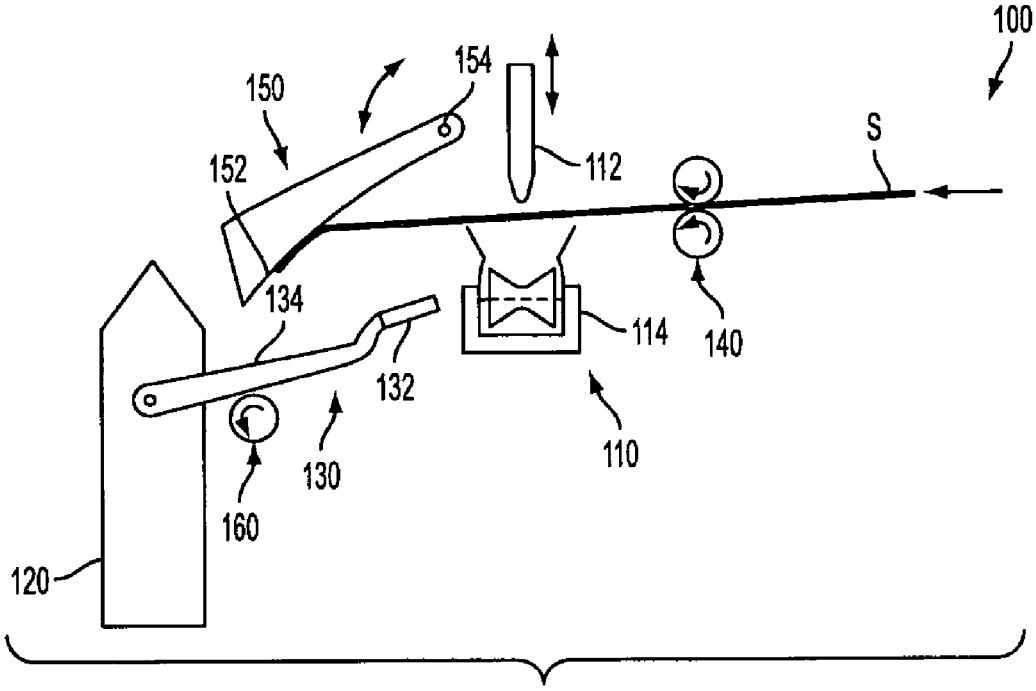
FIGS. 1A–1D are sequential side views of a sheet folding and accumulation system.

A sheet folding and accumulation system is illustrated in FIGS. 1A–1D which inverts folded sheets onto a saddle where the sheets are accumulated and bound into a booklet. The inverting of the sheets onto the saddle for accumulation and binding eliminates the need for the saddle or other sheet collection member to translate or pivot for location of the sheets onto the saddle.

A sheet folding and accumulation system 100 of FIGS. 1A–1D includes a folding mechanism 110 configured to form a fold in a sheet S, a saddle 120 for collecting folded sheets into a booklet for binding, and an inverting mechanism 130 for inverting the folded sheet and placing the folded sheet onto the saddle with the peak of the fold P in the sheet pointing upward. The system 100 can also include a main paper drive 140, a movable paper guide 150, and a secondary paper drive 160 for locating the sheet S on the saddle 120.

The folding mechanism 110 includes a vertically movable portion 112, such as a blade member, and a vertically fixed portion 114, such as a roller. As the blade member 112 presses the sheet into contact with the roller 114, a precise fold is formed in the sheet. The roller 114 may include one or more rollers which are movable along a length of the blade member 112 to form a fold along the entire width of the sheet. Although a movable blade member 112 is illustrated, the blade may also be fixed while the roller 114 or other folding mechanism is translated vertically to form the fold.

One example of a folding mechanism 110, is illustrated in the Trovinger PCT (WO 00/18583) which is incorporated herein by reference in its entirety. The folding mechanism of the Trovinger PCT employs two drive motor assemblies. A first vertical drive motor assembly operates to immobilize a sheet by pressing it against a fold blade with a folder assembly. This first vertical drive motor assembly moves a set of fold rollers into contact with both the sheet and a longitudinal fold blade. The axes of rotation for the fold rollers are perpendicular to the fold blade used to fold each sheet. A second horizontal drive motor then operates to deform the sheet against the fold blade by reciprocating the set of fold rollers, which have been placed into contact with the sheet, back and forth along the fold blade to crease the sheet. The number and spacing of these fold rollers are such that during horizontal movement of the fold rollers, at least one fold roller passes over every point along the portion of a sheet where a fold is to be formed.

In the Trovinger PCT two separate motors to establish linear motion of fold rollers in two axes to create a fold. The time to create a fold includes the cumulative time of moving a folder assembly vertically and moving the fold rollers horizontally to crease the sheet.

Other folding mechanisms 110 may also be used including many types of knife folding mechanisms, buckle folding mechanisms, and combinations. Another example of a folding mechanism is described in U.S. Pat. No. 4,053,150 (Lane), hereby incorporated by reference in its entirety, which includes a blade for forcing once-folded paper (e.g., a folded stack of newsprint) between a pair of rollers, thus creating a quarter-fold in the paper. Air flow jets and plates are used in the Lane patent to prevent bending of the paper edges and corners.

For the desktop booklet making systems described herein, folding mechanisms which operate on a single sheet or a small number of sheets and require a minimum space are particularly useful.

The inverting mechanism 130 places the folded sheets S onto the saddle 120 without requiring the saddle to move during sheet collection. One inverting mechanism 130, as shown in FIGS. 1A–1D, includes a sweeper plate 132 mounted on two sweeper arms 134 on opposite sides of the saddle 120. The sweeper plate 132 lifts the trailing end of the folded sheet S and sweeps the trailing end over the saddle 120 by rotation of the sweeper arms 134.

Figure 2:
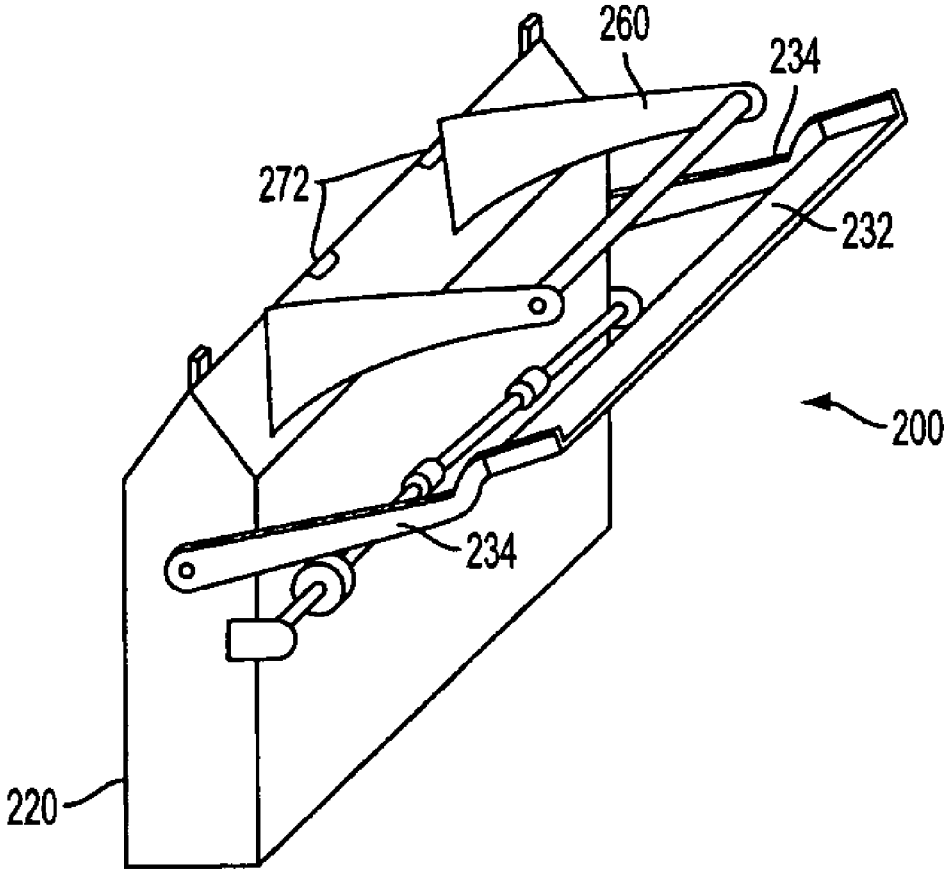
FIG. 2 is a perspective view of a portion of the system of FIGS. 1A–1D illustrating an inverting mechanism and saddle.

FIG. 2 is a perspective view of a system 200 showing the sweeper plate 232 and sweeper arms 234 in more detail. In one embodiment, the sweeper plate 232 may be mounted on a single sweeper arm. In another embodiment the sweeper plate 232 can be replaced with one or more rods. The sweeper plate(s) or rod(s) can include a non slip surface for grasping of the sheet as it is swept over the saddle 220.

Figure 4:
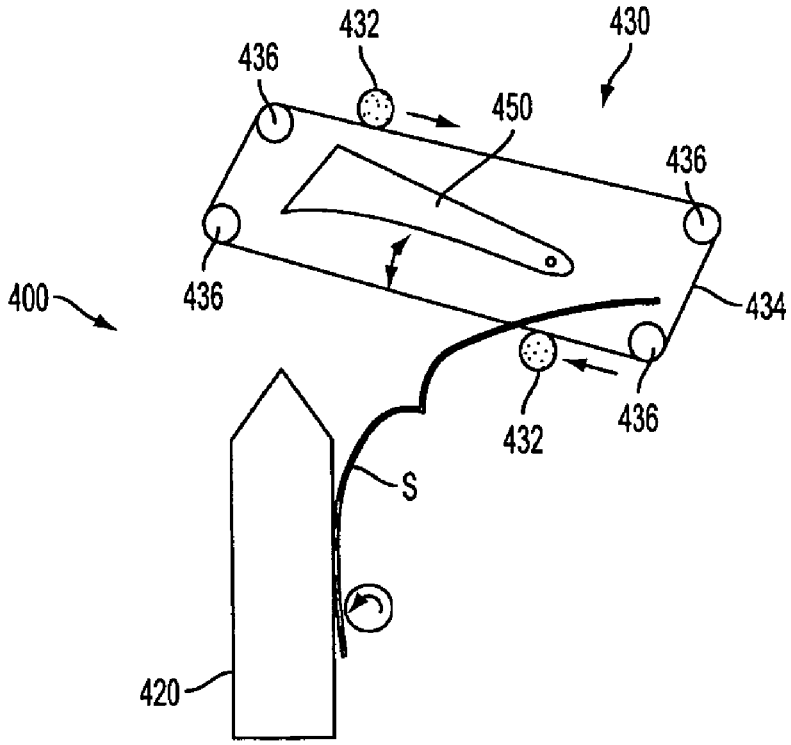
FIG. 4 is a side view of a portion of a sheet folding and accumulation system illustrating a belt driven inverting mechanism.
Figure 5:
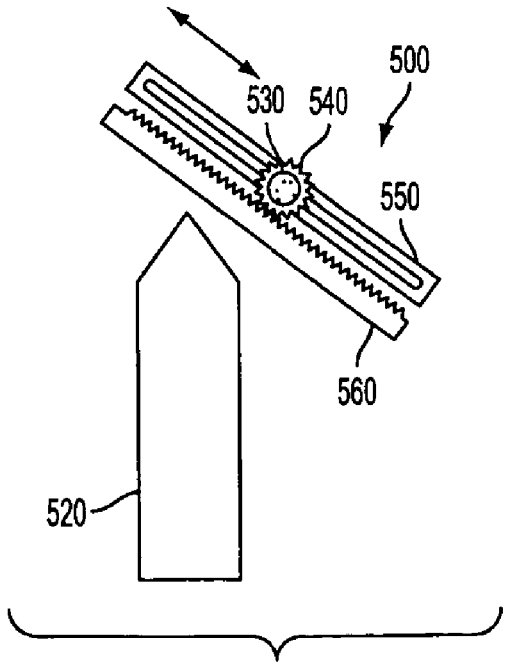
FIG. 5 is a side view of a portion of a sheet folding and accumulation system illustrating a gear and rack driven inverting mechanism.

The inverting mechanism 130 of FIGS. 1A–1D is designed to invert the folded sheet without significantly flattening the peak of the fold. Other alternative embodiments of the inverting mechanism 130 are illustrated in FIGS. 4 and 5 and will be discussed further below.

The sheet S is positioned with the leading edge of the sheet adjacent a trailing edge of the saddle 120 by a combination of the main paper drive 140, the movable paper guide 150, and the secondary paper drive 160. The paper guide 150 includes a curved guide surface 152 and a pivot 154 for moving the paper guide into position and moving the paper guide out of the path of the inverting mechanism 130. The secondary paper drive 160 advances the leading edge of the sheet S into position against the saddle 120 and holds the leading edge against the saddle during operation of the inverting mechanism 130.

Figure 1B:
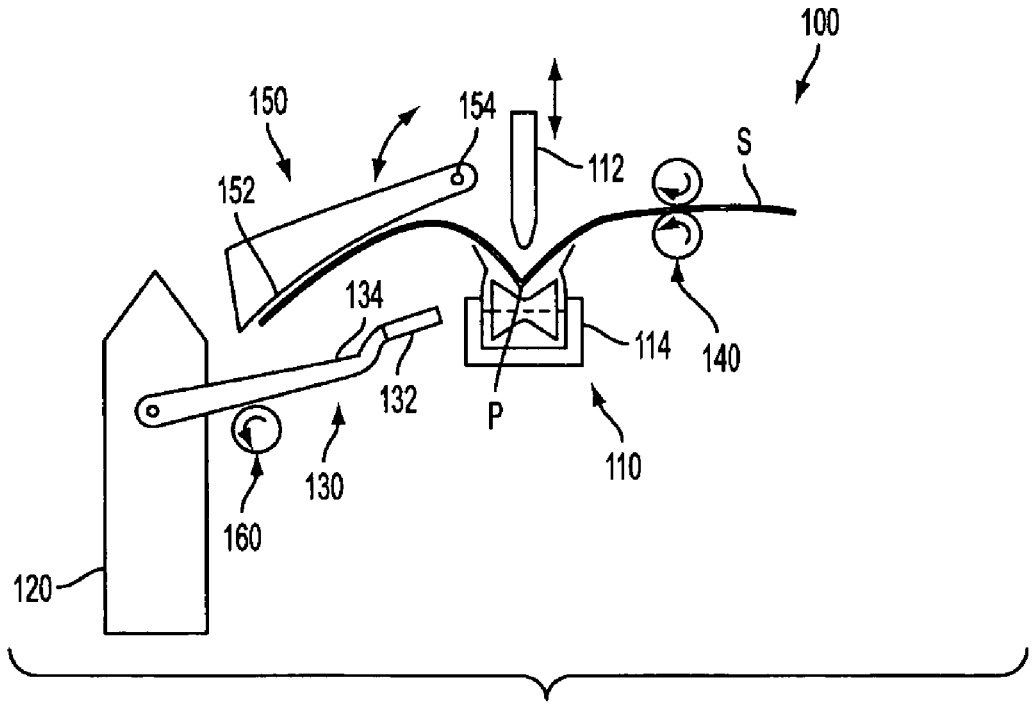
Figure 1C:
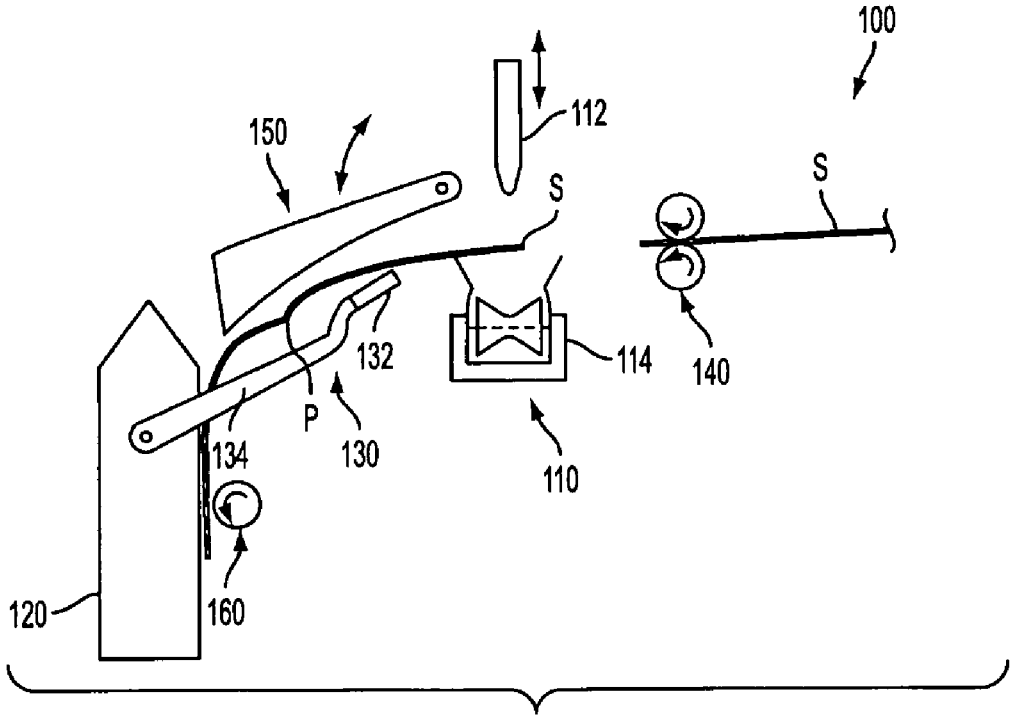

In operation, the sheet S is advanced into the folding mechanism 110 by the main paper drive 140, as shown in FIG. 1A. The folding mechanism 110 is then operated to form a fold in the sheet, as shown in FIG. 1B, with a peak P of the fold in the sheet pointing downward. The guide member 150 directs the leading edge of the sheet S to the secondary paper drive 160, as shown in FIGS. 1A–1C. When the sheet S has been advanced to the position shown in FIG. 1C the sweeper arms 134 are rotated to move the trailing edge of the sheet S over the leading edge of the sheet, thus inverting the sheet on the saddle 120.

Figure 1D:
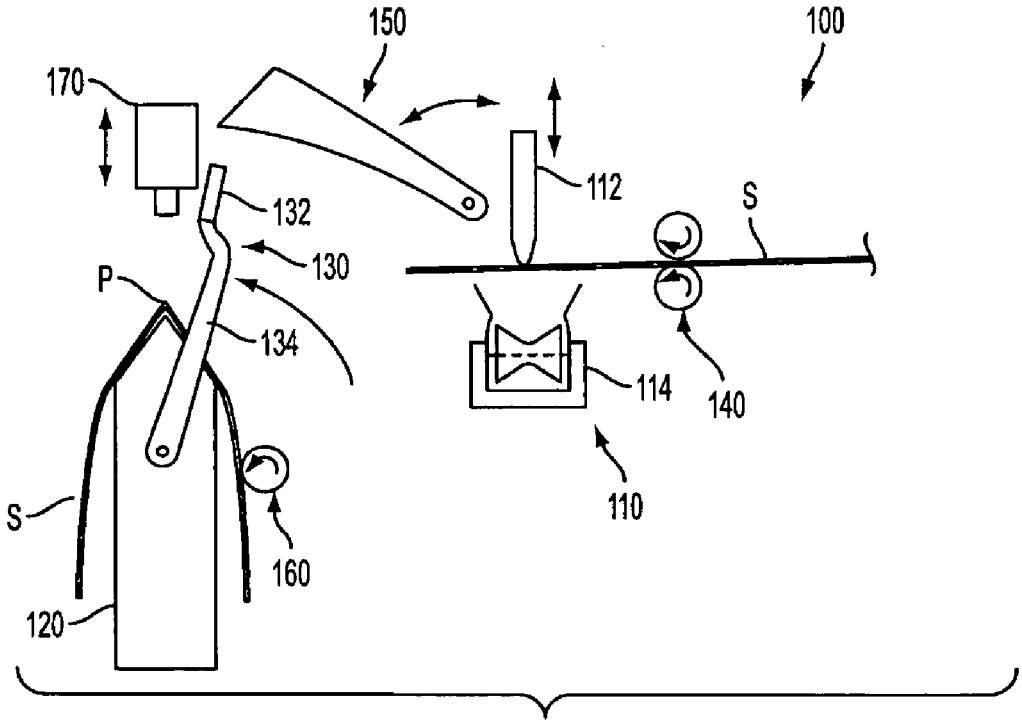

FIG. 1D illustrates the sheet S aligned on the saddle 120 with the peak P of the fold pointing upward and aligned on a peak of the saddle. The process of FIGS. 1A–1D is repeated with multiple sheets to form a stack of folded sheets on the saddle 120. The stack of folded sheets is then bound by a binding mechanism, such as a stapling assembly including a stapler 170 in combination with two or more anvil members on the saddle. The stapler 170 can move with respect to the saddle 120 for stapling the folded sheets collected on the saddle. The saddle 220 may also include lift pins for lifting the stapled booklets off of the saddle as described in the Trovinger PCT.

FIG. 2 illustrates one example of a saddle 220 having anvil members 272 configured for receiving and bending the ends of the staples. The anvil members 272 may be adjustable or may be provided in a plurality of spaced positions to accommodate sheets of different sizes, i.e. two staple or three staple booklets. The saddle 220 also includes guide members 222 at either end for aligning the stacked sheets. The guide members 222 can be fixed or adjustable.

FIG. 2 also illustrates one example of a pair movable paper guides 260 mounted on a rotatable shaft 262. The paper guides 250 can alternatively include a single elongated paper guide or more that two paper guides.

FIGS. 3A–3D illustrate a sequence of sheet folding and accumulation steps for an alternative system where a folding mechanism and direction of the initial fold is inverted compared to the system of FIGS. 1A–1D. In the system 300 of FIGS. 3A–3D the sharp fold line formed by the folding mechanism will allow the sheet to fold back on itself along the weak point of the fold causing the fold to break back on itself as the sheet is placed on the saddle.

Figure 3A:
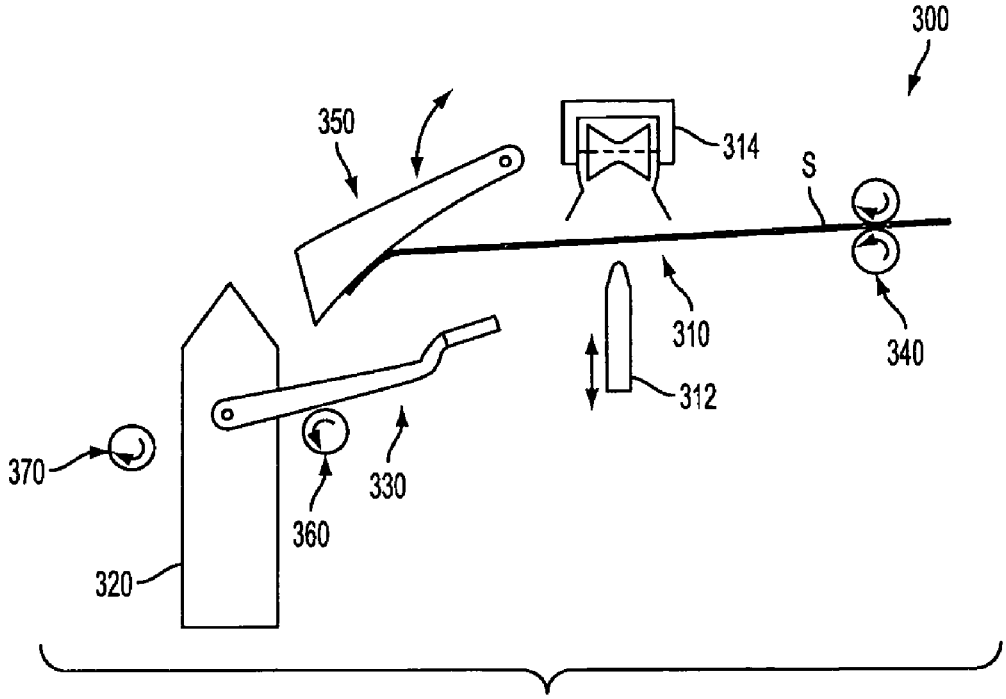
FIG. 3A–3B are sequential side views of an alternative sheet folding and accumulation system.

As shown in FIG. 3A, the system 300 includes a folding mechanism 310 configured to form a fold in a sheet S, a saddle 320 for collecting folded sheets into a booklet for binding, and an inverting mechanism 330 for inverting the folded sheet and placing the folded sheet onto the saddle with the peak of the fold P in the sheet pointing upward. As shown, the system 300 also includes a main paper drive 340, a movable paper guide 350, a secondary paper drive 360 for locating the sheet S on the saddle 320, and an additional drive 370 providing assistance in forming the final fold.

The folding mechanism 310 includes a vertically movable portion 312, such as a blade member, and a vertically fixed portion 314, such as a roller. As the blade member 312 presses the sheet into contact with the roller 314 and the roller moves along the blade, a precise fold is formed in the sheet S in the manner described above with respect to FIGS. 1A–1D. The initial fold formed in the sheet has a peak $P_1$ pointing upward. The initial fold is folded backwards to form the final fold having a peak pointing upward $P_2$.

Figure 3B:
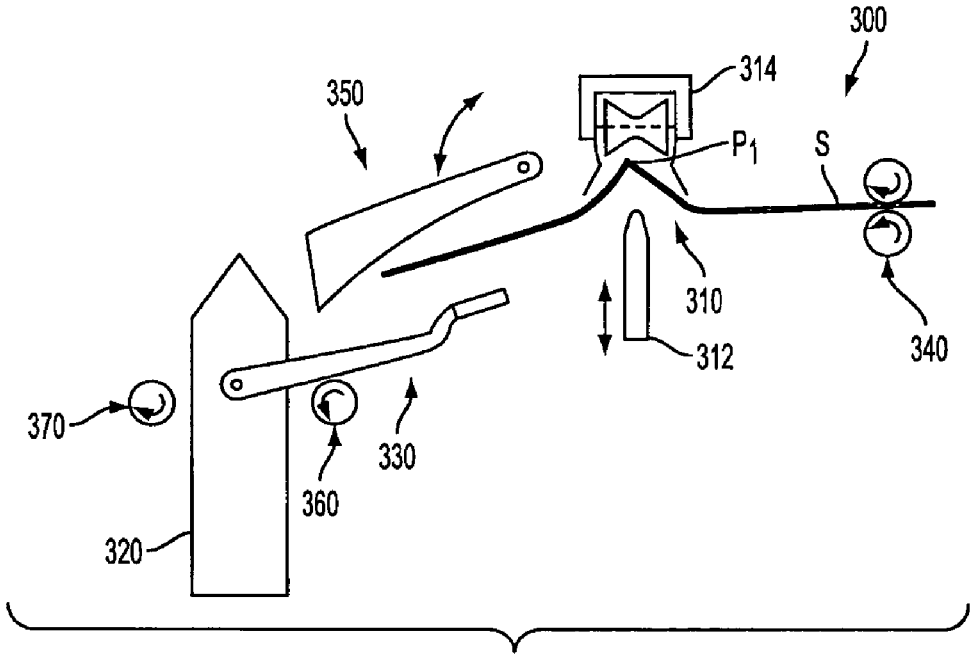
Figure 3C:
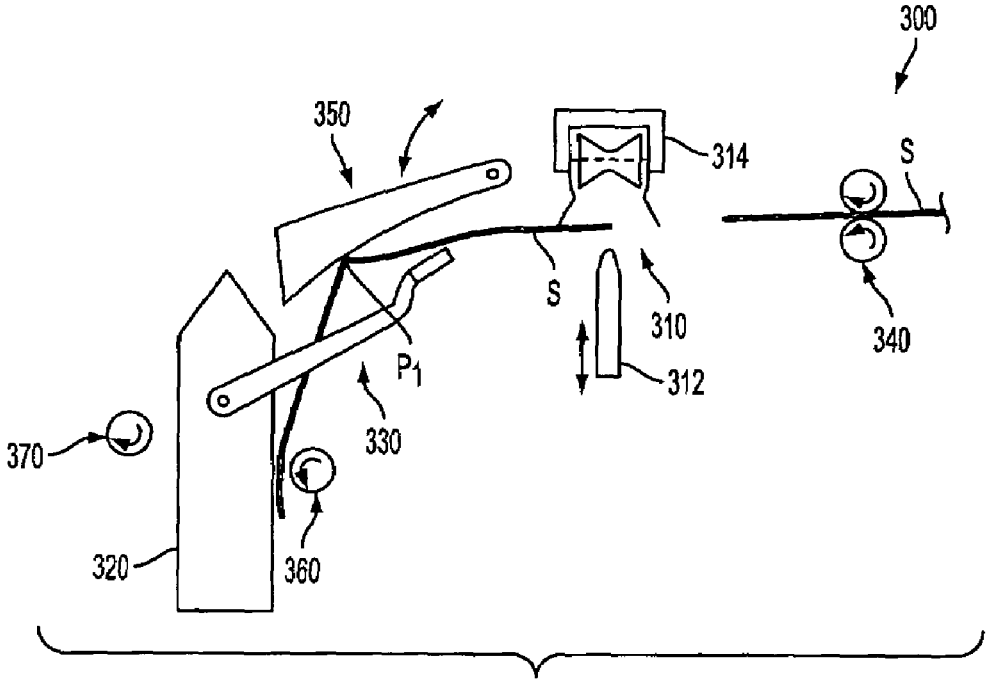
Figure 3D:
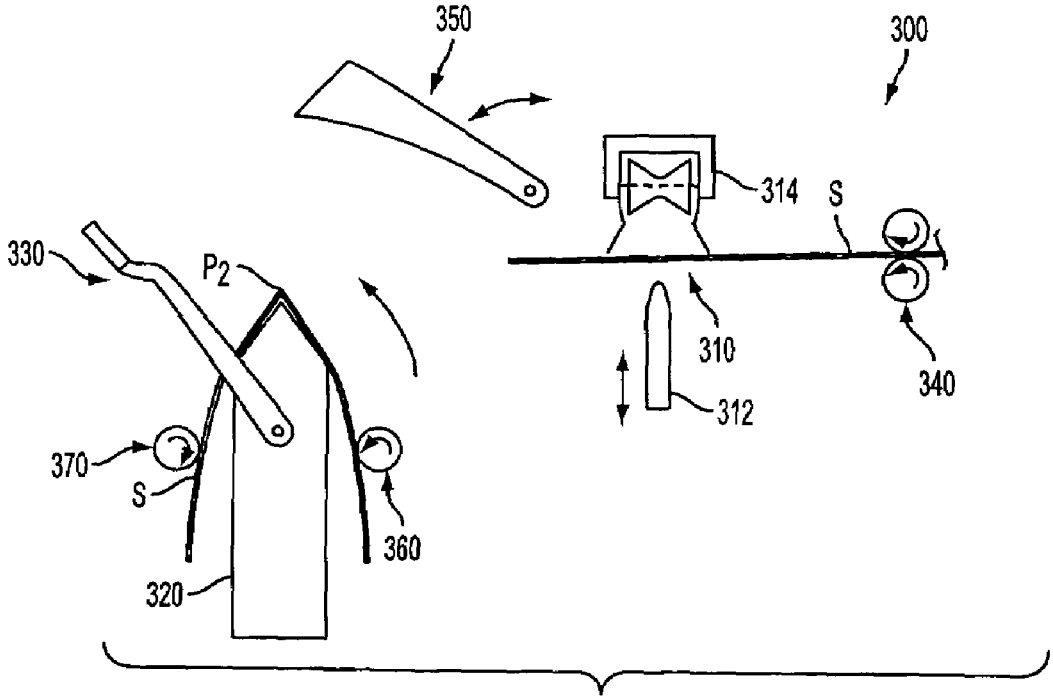

In operation of the embodiment of FIGS. 3A–3D, the sheet S is advanced into the folding mechanism 310 with the main paper drive 340, as shown in FIG. 3A. The folding mechanism 310 is then operated to form a fold in the sheet, as shown in FIG. 3B, with a peak $P_1$ of the fold in the sheet pointing upward. The guide member 350 directs the leading edge of the sheet to the secondary paper drive 360, as shown in FIGS. 3A–3C.

When the sheet S has been advanced to the position shown in FIG. 3C the sweeper arms 334 are rotated to move the trailing edge of the sheet S over the leading edge of the sheet, thus inverting the sheet on the saddle 320. The edge of the sheet which has been moved over the saddle 320 by the inverting mechanism 330 is grasped by the additional drive 370 and the drives 360, 370 move the sheet down onto the saddle causing the fold to break back on itself to form a peak $P_2$ pointing upward.

The process of FIGS. 3A–3D is repeated with multiple sheets S to form a stack of folded sheets on the saddle 320. The stack of folded sheets is then bound by a binding mechanism, such as a stapling assembly as described above.

FIG. 4 illustrates a system 400 with an alternative embodiment of an inverting mechanism 430 including a pair of sweeper bars 432 which are translatable by a belt 434 mounted on pulleys 436. The four pulleys 436 illustrated in FIG. 4 are arranged to move the belt 432 and sweeper bars 430 in a path which receives a trailing edge of the sheet S and translates the trailing edge over the leading edge and the saddle 420. The pair of sweeper bars 432 allows the second sweeper bar to move a second sheet while the first sweeper bar is returning to an initial position. The pulleys 436 are arranged in a substantially rectangular arrangement which avoids interference with the movable guide member 450.

FIG. 5 illustrates a system 500 having an inverting mechanism including a sweeper bar 530 mounted on a gear 540 which is translatable along a track 550 by motion of the gear along a rack 560 which is substantially parallel to the track. The sweeper bar 530 may be a plate, rod, or other shaped member which lifts and moves the trailing edge of the sheet over the saddle 520.

While the invention has been described in detail with reference to the preferred embodiments thereof, it will be apparent to one skilled in the art that various changes and modifications can be made and equivalents employed, without departing from the present invention.

What is claimed is:

1. A sheet folding and accumulation system which inverts folded sheets to assemble a booklet, the system comprising:

a folding mechanism configured to form a fold in a sheet;

a saddle for collecting folded sheets into a booklet for binding; and an inverting mechanism for inverting the folded sheet and placing the folded sheet onto the saddle with the peak of the fold in the sheet pointing upward, wherein the folding mechanism forms a fold with a peak of the fold in the sheet pointing upward and a supplemental drive device is arranged to move the folded and inverted sheet onto the saddle causing the fold to break back on itself.

2. The system of claim 1, wherein the saddle is located in a fixed position with respect to the folding mechanism.

3. The system of claim 2, wherein a portion of the folding mechanism is fixed.

4. The system of claim 1, wherein the inverting mechanism is rotatable with respect to the saddle.

5. The system of claim 1, wherein the inverting mechanism is translatable with respect to the saddle.

6. The system of claim 5, wherein the inverting mechanism includes a belt drive.

7. The system of claim 5, wherein the inverting mechanism includes a gear and rack drive.

8. The system of claim 1, comprising a stapling assembly movable with respect to the saddle for stapling the folded sheets collected on the saddle.

9. The system of claim 8, wherein the saddle includes a plurality of anvils configured to receive staples.

10. The system of claim 1, wherein the folding mechanism forms a fold with a peak of the fold in the sheet pointing downward.

11. The system of claim 10, wherein the folding mechanism includes a blade member positioned above a fold forming member.

12. The system of claim 11, wherein the fold forming member includes a movable roller which is movable along the blade member.

13. The system of claim 1, wherein the folding mechanism includes a blade member positioned below a fold forming member.

14. The system of claim 1, wherein the inverting mechanism lifts a trailing edge of the sheet and passes the trailing edge of the sheet over a leading edge of the sheet and places the inverted sheet on the saddle.

15. The system of claim 1, comprising a drive mechanism for delivering the sheets to the folding mechanism and then to the saddle.

16. A method of folding and accumulating sheets into a booklet, the method comprising:

a) folding a sheet in preparation for assembling the sheet into a booklet;

b) inverting the sheet and placing the inverted sheet onto a saddle with a peak of a fold in the sheet pointing upward;

c) repeating steps a) and b) with a plurality of sheets to form a stack of folded sheets on the saddle; and d) binding the stack of sheets on the saddle to form a booklet, wherein the step of inverting the sheet includes causing the fold formed in the folding step to break back on itself.

17. The method of claim 16, wherein the sheet is inverted by lifting a trailing edge of the folded sheet over a leading edge of the sheet.

18. The method of claim 16, wherein the sheets are placed on a fixed saddle.

19. The method of claim 16, wherein the folding step forms a fold in the sheet with a peak of the fold pointing downward.

20. The method of claim 16, wherein the folding step forms a fold in the sheet with a peak of the fold pointing upward.

21. A sheet folding and accumulation system which inverts folded sheets to assemble a booklet, the system comprising:

a folding mechanism configured to form a fold in a sheet;

a saddle for collecting folded sheets into a booklet for binding; and an inverting mechanism for inverting the folded sheet and placing the folded sheet onto the saddle with the peak of the fold in the sheet pointing upward, wherein the inverting mechanism lifts a trailing edge of the sheet and passes the trailing edge of the sheet over a leading edge of the sheet and places the inverted sheet on the saddle, wherein the inverting mechanism is translatable with respect to the saddle, and wherein the folding mechanism forms a fold with a peak of the fold in the sheet pointing upward and a supplemental drive device is arranged to move the folded and inverted sheet onto the saddle causing the fold to break back on itself.

22. The system of claim 21, wherein the saddle is located in a fixed position with respect to the folding mechanism.

23. The system of claim 22, wherein a portion of the folding mechanism is fixed.

24. The system of claim 21, wherein the inverting mechanism is rotatable with respect to the saddle.

25. The system of claim 21, wherein the inverting mechanism includes a belt drive.

26. The system of claim 21, wherein the inverting mechanism includes a gear and rack drive.

27. The system of claim 21, wherein the folding mechanism includes a blade member positioned below a fold forming member.

28. The system of claim 21, comprising a drive mechanism for delivering the sheets to the folding mechanism and then to the saddle.

29. The system of claim 21, comprising a stapling assembly movable with respect to the saddle for stapling the folded sheets collected on the saddle.

30. The system of claim 29, wherein the saddle includes a plurality of anvils configured to receive staples.

31. The system of claim 21, wherein the folding mechanism forms a fold with a peak of the fold in the sheet pointing downward.

32. The system of claim 31, wherein the folding mechanism includes a blade member positioned above a fold forming member.

33. The system of claim 32, wherein the fold forming member includes a movable roller which is movable along the blade member.

34. A method of folding and accumulating sheets into a booklet, the method comprising:

a) folding a sheet in preparation for assembling the sheet into a booklet;

b) lifting a trailing edge of the folded sheet over a leading edge of the sheet to invert the sheet and to place the inverted sheet onto a saddle with a peak of a fold in the sheet pointing upward;

c) repeating steps a) and b) with a plurality of sheets to form a stack of folded sheets on the saddle; and d) binding the stack of sheets on the saddle to form a booklet.

35. The method of claim 34, wherein the sheets are placed on a fixed saddle.

36. The method of claim 34, wherein the folding step forms a fold in the sheet with a peak of the fold pointing downward.

37. The method of claim 34, wherein the folding step forms a fold in the sheet with a peak of the fold pointing upward.

* * * * *